United States Patent [19]

Caton et al.

[11] 3,941,072

[45] Mar. 2, 1976

[54] STEERING SYSTEM FOR CANOES

[76] Inventors: Dolphus D. Caton, 149 Beebe Ave.; John R. Ralph, 180 College Part Drive, Apt. B-9, both of Elyria, Ohio 44035

[22] Filed: Feb. 11, 1975

[21] Appl. No.: 548,985

[52] U.S. Cl. ..... 114/165; 115/17; 248/4

[51] Int. Cl.[2] ..... B63H 25/06

[58] Field of Search ..... 114/162, 165; 115/17; 248/4; 9/1 D, 1 K

[56] References Cited

UNITED STATES PATENTS

| | | | |
|---|---|---|---|
| 1,100,954 | 6/1914 | Caille | 248/4 |
| 1,141,196 | 6/1915 | McLaren | 114/66.5 P |

*Primary Examiner*—Trygve M. Blix
*Assistant Examiner*—Gregory W. O'Connor
*Attorney, Agent, or Firm*—Bacon & Thomas

[57] ABSTRACT

A steering system that is easily attached to and removed from a canoe wherein the system includes a first frame section having adjustable brace members and a sling assembly for gripping the end edge of the canoe. A second frame section, pivotally secured to the first frame section, includes a pair of rudders and associated steering mechanism. A motor mount may also be provided on the second frame section for supporting an outboard motor such that when an obstacle is encountered beneath the surface of the water, the entire second frame section, including rudders, steering mechanism and motor, pivots from a downward operative position to an upward inoperative position, thereby bypassing the obstacle and preventing damage to the system.

10 Claims, 6 Drawing Figures

STEERING SYSTEM FOR CANOES

BACKGROUND OF THE INVENTION

1. Field of the Invention

The present invention relates generally to steering systems for light weight boats or water craft. More particularly, the present invention is directed to a steering system which may be advantageously utilized in conjunction with any of the many different kinds of canoes presently known in the prior art. Such steering systems are generally characterized by the presence of at least one rudder which can be pivotally mounted so that it may flip up and by-pass any obstructions or obstacles encountered beneath the surface of the water, thereby preventing damage to the system. Such systems may also include only a pivotal motor mount for securing an outboard motor that provides both the steering and propulsion functions for the boat.

It is now well recognized that canoes and similar types of light weight water craft are particularly useful for travel over shallow waters which may contain rocks, submerged logs and other dangerous obstructions or obstacles beneath and close to the water's surface. In order for any steering system or motor propulsion means to be utilized with a canoe in such waters, it is necessary to provide for a suitable mounting system for such devices in order to prevent possible damage thereto due to the obstructions and obstacles inevitably encountered. It is further highly desirable that the combination of a steering unit and a propulsion unit be incorporated within a single system that can be easily attached to and removed from the canoe, while simultaneously providing protection to the system should obstacles be encountered in the water. Also, because of the rather varied structural configurations and shapes in known canoe designs, it is highly desirable that any steering or propulsion system be capable of sufficient adjustability in order to adapt it for use with any given type of known canoe structure.

2. Description of the Prior Art

The prior art teaches many examples of systems for securing either a steering unit or motor propulsion unit to a canoe. Typical of such systems for mounting the motor at the end of a canoe are exemplified by the Nourse U.S. Pat. No. 3,601,344, Bartosch et al U.S. Pat. No. 3,645,483 and Hafele U.S. Pat. No. 2,475,889. All of these patents basically teach a generally rectangular-shaped framework which overlies one end of the canoe and is provided with a plate or supporting member for securing an outboard motor thereto. The Jones U.S. Pat. No. 2,631,559 discloses a canoe steering mechanism which exemplifies those systems incorporating provisions whereby the rudder may flip up and by-pass any obstacle or obstructions encountered beneath the surface of the water.

However, these prior art systems and other known similar systems fail to recognize that a steering or motor mount system must be provided with a wide range of adjustability so that it can conform to the exact configuration of any given canoe while simultaneously being capable of safe and rigid attachment thereto for actual use. Further, the prior art systems fail to recognize the advantage of such an adjustable system which also includes provisions for both a steering unit and a motor mount unit, whereby the combined units are capable of simultaneously by-passing obstacles or obstructions encountered beneath the water.

SUMMARY OF THE INVENTION

The present invention serves to overcome the undesirable and disadvantageous aspects of related prior art systems by providing for a steering system which includes a first frame section that is supported across one end of the canoe and carrying therewith a sling assembly which is pivotally adjustable for conforming to and gripping the canoe's end edge. A pair of longitudinally and pivotally adjustable brace members are secured to the first frame section for clamping engagement with the gunwales of the canoe. Another pair of longitudinally adjustable brace members connect the lower portion of the sling assembly to the first frame structure. A second frame structure carrying a steering mechanism in the form of two rudders and a motor mount member for supporting an outboard motor is pivotally secured to the first frame section for movement between a downward operative position and an upward inoperative position. The rudders are controlled by a pair of rudder shafts which may be rotated by any known conventional control means. The rudder shafts are supported within housings and are mounted for coordinated simultaneous rotation through a parallel linkage assembly. The lower portion of the sling assembly is connected to the second pair of adjustable brace members through a horizontal rod that also serves as a stop means for the second frame section in its downward operative position.

It is therefore an object of the present invention to provide for a steering system that can be adjusted to conform to the configuration of any canoe with which it is being utilized.

It is another object of the present invention to provide for a steering system for a canoe which system also includes a motor mount unit for supporting an outboard motor in combination with a steering unit.

It is a further object of the present invention to provide for a steering system for a canoe wherein the steering unit may pivot upwardly and by-pass any obstruction or obstacle encountered beneath the surface of the water, thereby preventing damage to the system.

It is a yet further object of the present invention to provide for a steering system for a canoe wherein the combination of a steering unit and an outboard motor unit utilized in conjunction therewith may automatically by-pass any obstruction or obstacle beneath the surface of the water.

It is yet still another object of the present invention to provide for a strong steering system which can be quickly attached to or removed from a canoe having any given configuration without altering the physical structure of the canoe.

These and other objects of the present invention will be apparent from the following description and appended claims, reference being made to the accompanying drawings forming a part of this specification wherein like reference characters designate corresponding parts in the several views.

DESCRIPTION OF THE PREFERRED EMBODIMENT

Figure 1:
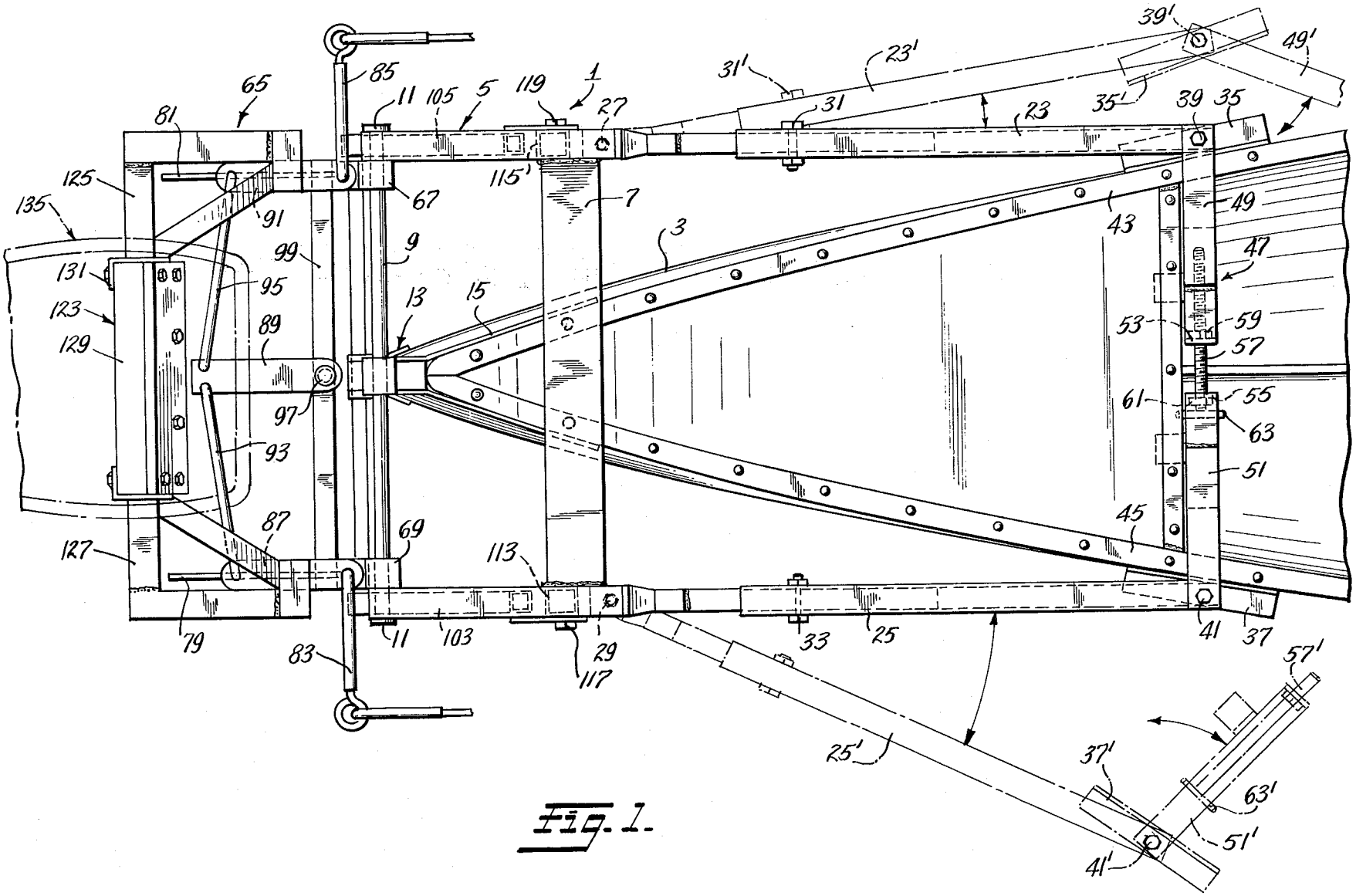
FIG. 1 is a fragmentary plan view of the steering system of the present invention as attached to a canoe, the brace members of the device being shown in phantom lines in an unassembled position.
Figures 2, 3:
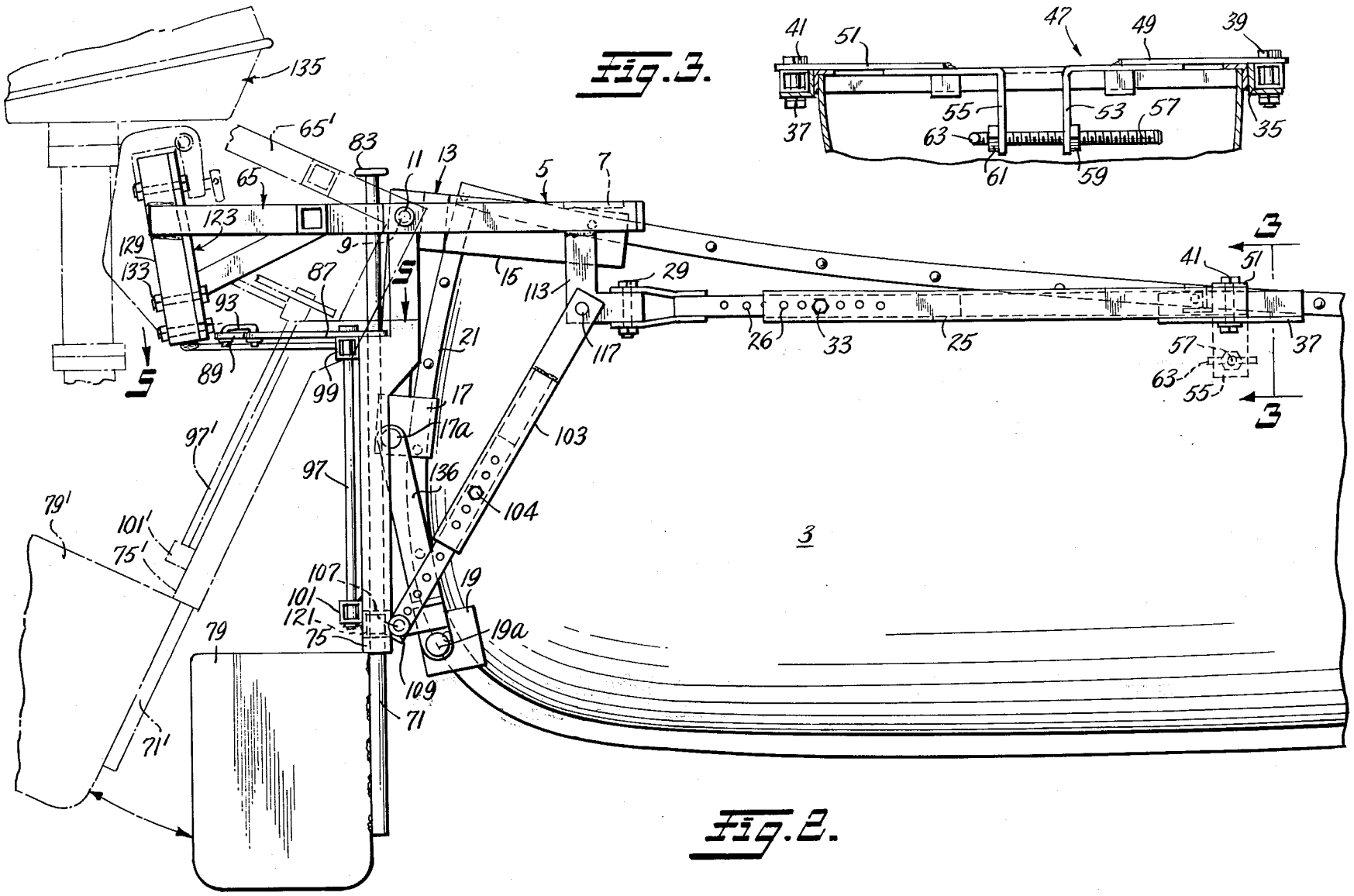
FIG. 2 is a fragmentary side elevational view of the steering system of FIG. 1 with the steering unit and motor mount unit being shown in a somewhat raised position in phantom lines.
FIG. 3 is a fragmentary vertical sectional view taken along the line 3—3 of FIG. 2.

As seen in FIGS. 1 and 2, the steering system 1 of the present invention is shown attached to a canoe 3 of any given type or configuration. The system 1 includes a first frame section 5 that is supported across the end of canoe 3 by means of a transverse member 7 which may take the form of a flat plate or strap. The rearward portion of frame section 5 is provided with a rod 9 journaled therethrough and secured in place by means of internally threaded bolts 11 or similar latching means permitting easy securing and removal of rod 9 from frame section 5. A sling assembly 13 is supported by rod 9 which is journaled within the upper end of assembly 13. A plurality of C-shaped brackets 15, 17 and 19 are provided on sling assembly 13 for gripping engagement with the edge portion 21 of canoe 3. As is apparent in FIG. 2, the uppermost bracket 15 is rigidly secured to member 7 by welding or the like. The brackets 17 and 19 may be pivotally attached to sling assembly 13 through bolts or similar mounting means 17*a* and 19*a*, respectively. As is noted in FIG. 2, sling assembly 13 comprises an upper portion 13*a* which is rigid and a lower portion 13*b* which is pivotally secured thereto by the pivot connection 17*a* of bracket 17. In this manner, the pivoting actions of brackets 17, 19 and lower portion 13*b* of sling assembly 13 permit the entire assembly to conform to the edge configuration of any given canoe.

Extending forwardly of the frame section 5 are a pair of longitudinal brace members 23 and 25 pivotally secured to frame section 5 for lateral movement by bolts 27 and 29. Brace members 23 and 25 may be in the form of telescopic channel-shaped members provided with a plurality of corresponding longitudinally spaced holes or apertures 24 and 26 which permit longitudinal adjustment by means of lock bolts 31 and 33. The ends of brace members 23 and 25 are provided with pressure plates 35 and 37 pivotally secured thereto by bolts 39 and 41, respectively. As is shown in FIG. 1 in phantom lines, brace members 23 and 25 may be laterally pivoted and adjusted to conform to the width of any given canoe. Similarly, pressure plates 35 and 37 may also pivot to press against and assume the exact curvature or configuration of the canoe's gunwales 43 and 45.

As is shown in FIG. 3, a clamping means 47 including arms 49 and 51 is connected to brace members 23 and 25 through bolts 39 and 41. Arms 49 and 51 are provided with downwardly depending flanges 53 and 55 which are joined by a threaded bolt 57 and nuts 59 and 61. A handle 63 is provided on the end of bolt 57 through which pressure may be applied to draw flanges 53 and 55 closer together, thereby forcing pressure plates 35 and 37 firmly against the gunwales 43 and 45 of the canoe 3.

A second frame section 65 is pivotally secured to first frame section 5 by rod 9 which is journaled within holes 67 and 69 provided in frame section 65. A pair of rudder shafts 71 and 73 are mounted within a pair of shaft housings 75 and 77 secured to second frame section 65 as an integral portion thereof. The lower end of rudder shafts 71 and 73 are provided with rudders 79 and 81. The upper ends of rudder shafts 71 and 73 are provided with rotatable steering arms 83 and 85 which, through any known conventional steering control means, serve to impart rotative motions to rudder shafts 71 and 73, thereby directing the position of rudders 79 and 81. Examples of control means suitable for operating steering arms 83 and 85 are disclosed by the Caton et al U.S. Pat. No. 3,844,243, which patent and its disclosure are herewith being incorporated by reference thereto.

Figure 4:
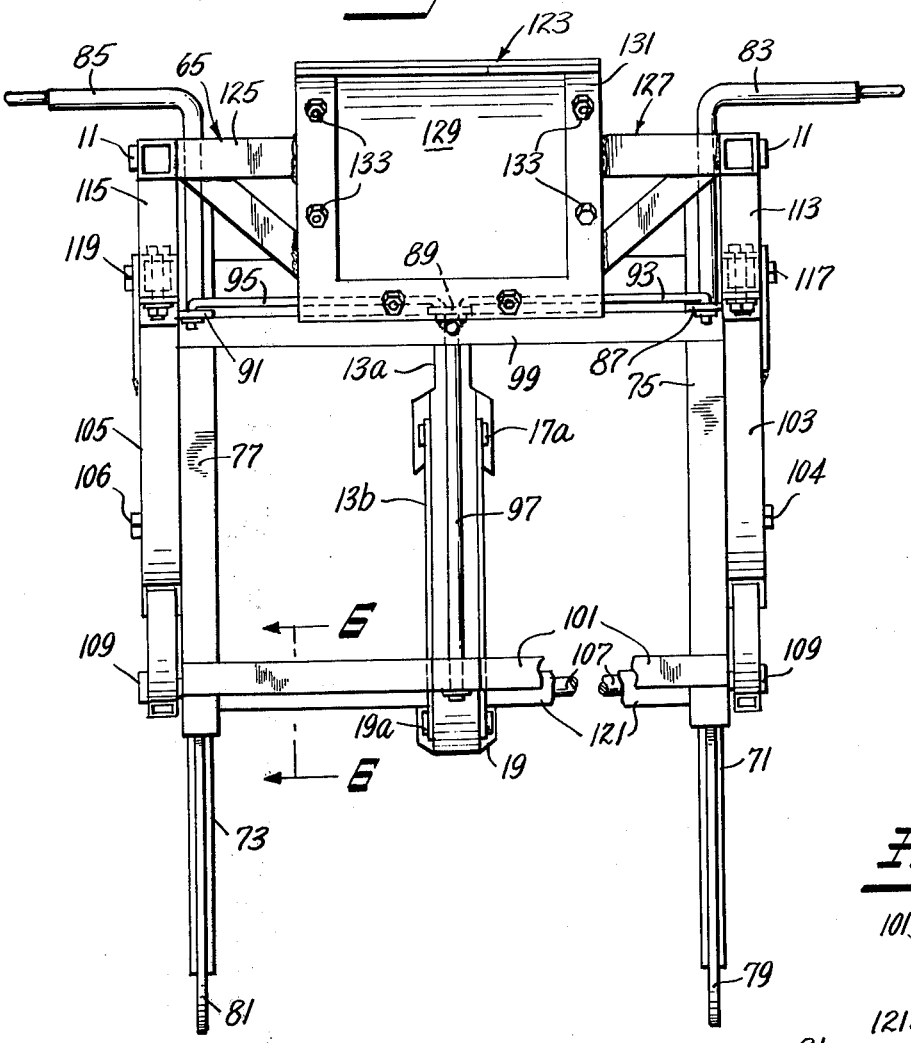
FIG. 4 is a rear elevational view, partly broken away, of the devide shown in FIGS. 1 and 2.
Figure 5:
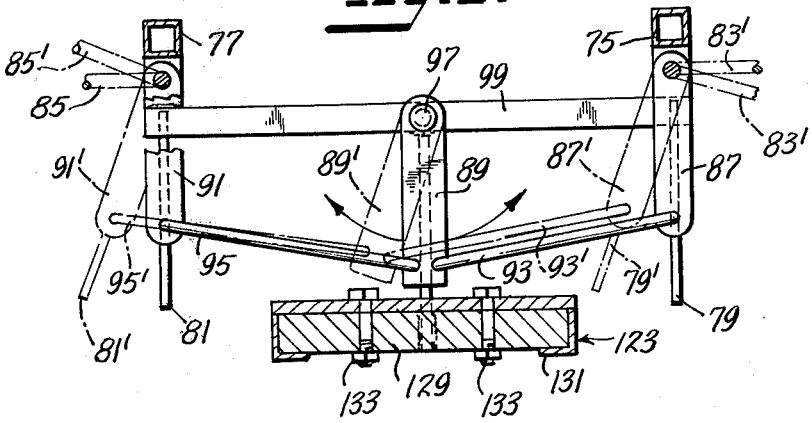
FIG. 5 is a fragmentary horizontal sectional view taken along line 5—5 of FIG. 2.

As is more clearly shown in FIG. 5, steering arms 83 and 85 control the rotative movements of shafts 71 and 73 through a parallel linkage assembly that includes pivotal plates 87, 89 and 91. Plates 87 and 91 are rigidly secured to shafts 71 and 73. Plates 87 and 89 are joined by a linkage rod 93 and plates 91 and 89 are joined by a linkage rod 95. As is therefore apparent, any rotative motion imparted to either of the steering arms 83 or 85 will impart a similar and parallel rotative movement to the opposite steering arm through the parallel linkage comprising pivotal plates 87, 89 and 91 and linkage rods 93 and 95. Pivotal plate 89, mounted midway between plates 87 and 91 is pivotally secured to the upper end of a vertical brace rod 97 which joins two horizontal channel braces 99 and 101. As is evident in FIG. 4, braces 99 and 101 impart rigidity and strength to rudder shaft housings 75 and 77 to which they are secured.

Figure 6:
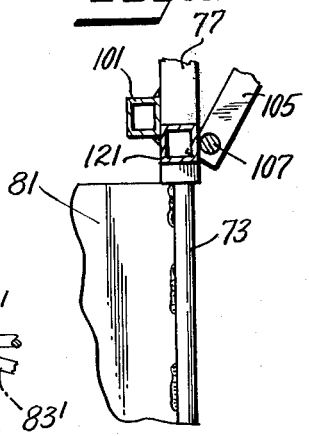
FIG. 6 is a fragmentary vertical sectional view taken along the line 6—6 of FIG. 4.

Referring more particularly now to FIGS. 2, 4 and 6, the lowermost portion of sling assembly 13 is joined to first frame section 5 through a second pair of longitudinal brace members 103 and 105 which may assume the same structural characteristics for longitudinal adjustment as was previously described for brace members 23 and 15, i.e., adjustment bolts 104 and 106. A horizontal rod 107 is rotatably journaled through the bottom portion of sling assembly 13 and has its ends rotatably secured through the lower portions of brace members 103 and 105. Internally threaded bolts 109 or similar fastening may be utilized to secure rod 107 in place in the manner previously described for rod 9. The upper ends of brace members 103 and 105 are pivotally secured to downwardly depending sections 113 and 115 of first frame section 5 by means of bolts 117 and 119, respectively. As is shown in FIG. 2 and more particularly in FIG. 6, shaft housings 75 and 77 are provided with an additional cross brace 121. In its downward operative position, brace 121 of second frame section 65 makes abutting contact with rod 107 which acts as a stop means against which section 65 is abutted.

Referring now to FIGS. 4 and 5, a motor mount unit 123 may be secured to second frame section 65 by means of cross braces 125 and 127. The unit 123 may include a flat plate of wood 129 provided with a peripheral metal flange 131 secured thereto by bolts 133 for added strength. As seen in FIG. 2, an outboard motor 135 of conventional design may be clamped onto motor mount unit 123 for use in conjunction with the entire steering system of the present invention.

The entire construction of the steering system of the present invention, including brace members, cross braces, shaft housings and the like may be wholly of metal or partly of metal and other suitable materials.

The parts may be bolted, welded, glued or secured together by any well known and suitable connection method or means which will serve to impart strength and rigidity to the overall system for its intended use. Because of the aquatic environment in which the steering system of the present invention is to be utilized, it is advantageous that the construction thereof be based upon aluminum or similar non-oxidizing metal parts which will impart a high degree of overall strength and stability to the system without the disadvantage of rust and corrosion.

MODE OF OPERATION

The steering system of the present invention may be attached to any given canoe 3 by placing member 7 of first frame section 5 across the upper gunwales of an end of canoe 3. The sling assembly 13 is fitted and adjusted to conform to the end edge 21 of canoe 3 by pivoting lower portion **13*b* of sling assembly 13 at point 17*a* through longitudinal adjustments of brace members 103 and 105 such that C-shaped brackets 15, 17 and 19 are brought into gripping engagement with end edge 21 of canoe 3. Brace members 23 and 25 are then pivoted laterally about bolts 27 and 29 such that pressure plates 35 and 37 come into fitting engagement with the side contours of gunwales 43 and 45. Arms 49 and 51 are then pivoted about bolts 39 and 41 into a position transverse of the canoe's longitudinal axis. Threaded bolt 57 may then be manually tightened through handle 63 so that downwardly depending flanges 53 and 55 are brought closer together, thereby exerting pressure against side portions of gunwales 43 and 45 through plates 35 and 37, respectively. An outboard motor 135 of conventional design may be clamped onto motor mount unit 123.** The entire steering system of the present invention is now ready for use in travelling over water which may contain obstacles and obstructions.

Should the rudder shaft 71 and 73 encounter an obstacle in the water, the entire second frame section 65, including motor, rudders and steering mechanism, being pivotally journaled to rod 9 at 67 and 69, is raised to an upward inoperative position, thereby by-passing the obstacle in the water. When the obstacle has been cleared, the weight of the entire second frame section 65 causes it to pivot downwardly until channel 121 strikes rod 107, thereby placing the entire system in an operative position again. It is to be understood that the form of the invention herewith shown and described is to be taken as a preferred example of the same, and that various changes in the shape, size and arrangement of parts may be resorted to, without departing from the spirit of the invention or scope of the subjoined claims.

What is claimed is:

1. A steering system for a canoe comprising, in combination:

A. a first frame section for support across an end of the canoe,

B. a first pair of longitudinally adjustable brace members secured to the first frame section for engagement with the gunwales of the canoe, C. a pivotally adjustable sling assembly secured at its upper portion to the first frame section for conforming engagement with the end edge of the canoe, D. a second pair of longitudinally adjustable brace members connecting the lower portion of the sling assembly to the first frame section, and E. a second frame section pivotally connected to the first frame section for movement between an upper inoperative position and a lower operative position.

2. The system of claim 1 wherein the sling assembly includes:

A. a pivotal connection between its upper and lower portions, and

B. a plurality of C-shaped brackets for gripping the end edge of the canoe.

3. The system of claim 1 wherein the second frame section includes:

A. a pair of rudder shafts,

B. a rudder secured at the lower end of each shaft,

C. a steering arm secured to the upper end of each shaft for imparting rotative motion thereto, and D. a pair of housings supporting the shafts for rotational movement.

4. The system of claim 1 wherein the second frame section further includes a motor mounting member.

5. The system of claim 3 wherein the rudder shafts are joined for simultaneous rotational movement by means of a parallel linkage assembly.

6. The system of claim 1 wherein the first pair of brace members are pivotally secured to the first frame section and include clamping means at the ends thereof for detachable connection with the gunwales of the canoe.

7. The system of claim 6 wherein the clamping means includes:

A. a pair of pressure plates for engaging the gunwales, and

B. a threaded bolt and nut assembly for tightening the plates against the gunwales.

8. A steering system for a canoe comprising, in combination:

A. a first frame section for support across an end of the canoe,

B. a first pair of longitudinally adjustable brace members secured to the first frame section for engagement with the gunwales of the canoe, C. a sling assembly secured at its upper portion to the first frame section for engagement with the end edge of the canoe, D. a second pair of longitudinally adjustable brace members connecting the lower portion of the sling assembly to the first frame section, E. a second frame section pivotally connected to the first frame section for movement between an upper inoperative position and a lower operative position, and F. a horizontal rod connecting the second pair of longitudinally adjustable brace members to the lower portion of the sling assembly, which horizontal rod also serves as an abutment means for the second frame section in its downward operative position.

9. A steering system for a canoe comprising, in combination:

A. a first frame section for support across an end of the canoe,

B. a first pair of longitudinally adjustable brace members secured to the first frame section for engagement with the gunwales of the canoe, which first pair of brace members each include:

1. a pair of telescoping members provided with corresponding apertures, and 2. a locking bolt detachably secured within the corresponding apertures to maintain the telescoping members in their desired longitudinal adjustment, C. a sling assembly secured at its upper portion to the first frame section for engagement with the end edge of the canoe, D. a second pair of longitudinally adjustable brace members connecting the lower portion of the sling assembly to the first frame section, which second pair of brace members each include:

1. a pair of telescoping members provided with corresponding apertures,
2. a locking bolt detachably secured within the corresponding apertures to maintain the pair of telescoping members in their desired longitudinal adjustment, and E. a second frame section pivotally connected to the first frame section for movement between an upper inoperative position and a lower operative position.

10. A steering system for a canoe comprising, in combination:

A. a first frame section for support across an end of the canoe, which first frame section includes:

1. a pair of rudder shafts joined for simultaneous rotational movement by a parallel linkage assembly including a plurality of pivotal plates and a plurality of linkage rods joining the pivotal plates,
2. a rudder secured at the lower end of each shaft,
3. a steering arm secured to the upper end of each shaft for imparting rotational motion thereto, and
4. a pair of housings supporting the shafts for rotational movement, B. a first pair of longitudinally adjustable brace members secured to the first frame section for engagement with the gunwales of the canoe, C. a sling assembly secured at its upper portion to the first frame section for engagement with the end edge of the canoe, D. a second pair of longitudinally adjustable brace members connecting the lower portion of the sling assembly to the first frame section, and E. a second frame section pivotally connected to the first frame section for movement between an upper inoperative position and a lower operative position.

* * * * *